US008910829B2

(12) United States Patent
Lazaris et al.

(10) Patent No.: US 8,910,829 B2
(45) Date of Patent: Dec. 16, 2014

(54) METHOD AND APPARATUS FOR BEVERAGE EXTRACTION NEEDLE GUIDING

(71) Applicant: Coravin, LLC, Burlington, MA (US)

(72) Inventors: Nicholas G. Lazaris, Newton, MA (US); Otto Deruntz, Dunstable, MA (US); Mike Rider, Lowell, MA (US)

(73) Assignee: Coravin, Inc., Burlington, MA (US)

( * ) Notice: Subject to any disclaimer, the term of this patent is extended or adjusted under 35 U.S.C. 154(b) by 57 days.

(21) Appl. No.: 13/793,357

(22) Filed: Mar. 11, 2013

(65) Prior Publication Data

US 2014/0097198 A1 Apr. 10, 2014

Related U.S. Application Data

(60) Provisional application No. 61/711,485, filed on Oct. 9, 2012.

(51) Int. Cl.
*B67D 7/00* (2010.01)
*B67D 1/04* (2006.01)

(52) U.S. Cl.
CPC ..... *B67D 1/0412* (2013.01); *B67D 1/0418* (2013.01)
USPC ..... 222/5; 222/399; 222/82; 222/83; 141/330

(58) Field of Classification Search
CPC ..... B67D 1/0412; B67D 1/0418
USPC ..... 222/5, 399, 81–83, 89; 141/330
See application file for complete search history.

(56) References Cited

U.S. PATENT DOCUMENTS

| | | | | |
|---|---|---|---|---|
| 718,163 | A | 1/1903 | Sherrard | |
| 1,509,916 | A | 9/1924 | Waite | |
| 2,367,077 | A | 1/1945 | Ward | |
| 2,496,258 | A | 2/1950 | Alexander | |
| 2,536,160 | A * | 1/1951 | Duggan | 222/81 |
| 2,705,578 | A | 4/1955 | Burns | |
| 3,076,484 | A * | 2/1963 | Tennant | 141/17 |
| 3,191,533 | A | 6/1965 | Vandenberg | |
| 3,200,094 | A | 8/1965 | Levinson et al. | |
| 3,203,592 | A * | 8/1965 | Farandatos | 222/5 |
| 3,227,310 | A * | 1/1966 | Farandatos | 222/5 |
| 3,272,404 | A | 9/1966 | Graves et al. | |

(Continued)

FOREIGN PATENT DOCUMENTS

| | | | |
|---|---|---|---|
| FR | 2248008 | A1 | 5/1975 |
| GB | 1076126 | A | 7/1967 |
| WO | WO 2005058744 | A2 | 6/2005 |

OTHER PUBLICATIONS

International Search Report and Written Opinion dated Jan. 29, 2014 from corresponding PCT Application No. PCT/US2013/063819.

*Primary Examiner* — Donnell Long
(74) *Attorney, Agent, or Firm* — Wolf, Greenfield & Sacks, P.C.

(57) ABSTRACT

Devices and methods for guiding a needle in movement through a bottle closure, such as a cork, to extract fluids from the bottle without removal of the cork. A needle may be attached to a device body by a needle base, which includes a surface arranged to engage with a needle guide to guide movement of the needle base and needle relative to the guide. A needle guide may also provide a shield for the needle tip and/or a needle opening.

27 Claims, 12 Drawing Sheets

(56) References Cited

U.S. PATENT DOCUMENTS

| | | | | |
|---|---|---|---|---|
| 3,327,899 | A | 6/1967 | Reynolds et al. | |
| 3,883,043 | A | 5/1975 | Lane | |
| 3,976,221 | A | 8/1976 | Martin et al. | |
| 4,011,971 | A | 3/1977 | Haydon | |
| 4,143,678 | A | 3/1979 | Sugimura et al. | |
| 4,473,174 | A | 9/1984 | Heuser | |
| 4,475,576 | A | 10/1984 | Simon | |
| 4,595,121 | A | 6/1986 | Schultz | |
| 4,674,662 | A | 6/1987 | Bergstrom et al. | |
| 4,691,482 | A | 9/1987 | Heinemann et al. | |
| 4,694,850 | A | 9/1987 | Fumino | |
| 4,706,847 | A | 11/1987 | Sankey et al. | |
| 4,856,680 | A | 8/1989 | Sitton | |
| 4,867,209 | A | 9/1989 | Santoiemmo | |
| 4,932,561 | A | 6/1990 | Boxall | |
| 4,976,984 | A | 12/1990 | Yasukawa et al. | |
| 4,982,879 | A | 1/1991 | Corrando et al. | |
| 4,984,711 | A * | 1/1991 | Ellis | 222/82 |
| 5,020,395 | A | 6/1991 | Mackey | |
| 5,031,799 | A | 7/1991 | Owen | |
| 5,139,179 | A | 8/1992 | Cecil | |
| 5,163,909 | A | 11/1992 | Stewart | |
| 5,180,081 | A | 1/1993 | McCann | |
| 5,395,012 | A | 3/1995 | Grill et al. | |
| 5,407,096 | A | 4/1995 | Smith | |
| 5,413,230 | A | 5/1995 | Folter et al. | |
| 5,413,247 | A | 5/1995 | Glasa | |
| 5,590,696 | A | 1/1997 | Phillips et al. | |
| 5,947,172 | A | 9/1999 | Glotin | |
| 6,371,173 | B1 | 4/2002 | Liebmann, Jr. | |
| 6,477,920 | B1 * | 11/2002 | Yang | 81/3.2 |
| 6,607,100 | B2 | 8/2003 | Phelps et al. | |
| 6,789,698 | B2 | 9/2004 | Gloor et al. | |
| 6,843,388 | B1 | 1/2005 | Hollars | |
| 7,056,179 | B2 | 6/2006 | Courtney | |
| 7,712,637 | B2 * | 5/2010 | Lambrecht | 222/400.7 |
| 8,033,431 | B2 | 10/2011 | Sommerfield et al. | |
| 8,225,959 | B2 | 7/2012 | Lambrecht | |
| 2010/0006603 | A1 | 1/2010 | Weinberg et al. | |
| 2011/0016692 | A1 | 1/2011 | Hollars | |
| 2011/0204093 | A1 * | 8/2011 | Lee | 222/152 |

* cited by examiner

METHOD AND APPARATUS FOR BEVERAGE EXTRACTION NEEDLE GUIDING

RELATED APPLICATIONS

This application claims the benefit under 35 U.S.C. §119 (e) of U.S. provisional application No. 61/711,485, filed Oct. 9, 2012, which is incorporated by reference herein in its entirety.

BACKGROUND OF INVENTION

This invention relates generally to the dispensing or other extraction of fluids from within a container, e.g., in the dispensing of wine from a wine bottle.

SUMMARY OF INVENTION

One or more embodiments in accordance with aspects of the invention allow a user to withdraw or otherwise extract a beverage, such as wine, from within a container that is sealed by a cork, plug, elastomeric septum or other closure without removing the closure. In some cases, removal of liquid from such a container may be performed one or more times, yet the closure may remain in place during and after each beverage extraction to maintain a seal for the container. Thus, the beverage may be dispensed from the bottle multiple times and stored for extended periods between each extraction with little or no effect on beverage quality. In some embodiments, little or no gas, such as air, which is reactive with the beverage may be introduced into the container either during or after extraction of beverage from within the container. Thus, in some embodiments, a user may withdraw wine from a wine bottle without removal of, or damage to, the cork, and without allowing air or other potentially damaging gasses or liquids entry into the bottle.

In one aspect of the invention, a beverage extraction device includes a base for supporting components of the beverage extraction device, and a needle movably mounted to the base and arranged to be inserted through a closure at an opening of a beverage container. The needle may extend from a proximal end to a distal end and have at least one lumen that is arranged for introducing gas into a container or allowing beverage to flow from the container. A needle base may be arranged at the proximal end of the needle and have an engagement surface, and a needle guide may be attached to the base and have an opening, such as a slot or circular opening, to guide the needle in movement relative to the base. An engagement surface of the needle guide may be arranged to contact the engagement surface of the needle base to guide movement of the needle base and needle relative to the needle guide. Engagement of the needle guide with the needle base may help properly align a portion of the needle with the needle guide, and/or help reduce bending stress on the needle as the needle is inserted into the container closure. In addition, the needle guide may help shield the needle tip from contact, and/or help shield any spray from the needle opening.

In one embodiment, the engagement surface of the needle guide may include a conically shaped hole, and the engagement surface of the needle base may include a conically shaped member arranged to fit into the conically shaped hole. The conically shaped hole may be wider at a proximal end that is nearer the needle base than at a distal end, e.g., so that the conical member of the needle base, which may have a size and shape that is complementary to the hole, may be received into the hole. The needle guide may include a through hole arranged to receive the needle, and the through hole may be arranged at the distal end of the conically shaped hole.

In another embodiment, the needle base may include a hole that receives a portion of the needle guide. For example, the needle base may include a hole that flares outwardly and downwardly around the needle shaft and receives a tapered protrusion of the needle guide. Engagement of the hole of the needle base with the protrusion may help guide the needle's movement and/or help reduce stress on the needle. In yet another embodiment, the needle base and needle guide may each have a pair of engagement surfaces, e.g., that are concentric relative to each other and engage with a corresponding engagement surface of the needle base or guide.

In some embodiments, the needle guide may be fixed relative to the base, although in other embodiments the needle guide may be separable from, or otherwise moveable relative to the base. The needle and needle base may be guided in movement relative to the base, e.g., the needle and needle base may be attached to a rail, and the base may include a channel arranged to receive and guide movement of the rail relative to the base. The rail may be part of a body, to which the needle base and needle are attached, and the body may include other components of the system, such as a gas regulator and one or more flow control valves to control flow of gas into a container and beverage out of the container. The body may also include a handle that allows a user to grip and move the body relative to the base, e.g., to insert or withdraw the needle with respect to a closure of a beverage container. The needle base may be threadedly engaged with the body such that the needle base and needle are removable from the body, e.g., for replacement, although other connections are possible, such as a bayonet, Luer or other removable connection, or fixed connections between the needle base (or needle) and the body.

As noted above, the needle may be arranged for insertion through a cork of a wine bottle and for delivery of a gas into the wine bottle, and/or for delivery of wine from the bottle. For example, the system may include a gas source, such as a compressed gas cylinder, fluidly coupled to the needle and arranged to deliver pressurized gas to the at least one lumen at the proximal end of the needle. Delivery of gas to the container may allow beverage to be extracted from the container, e.g., by having the pressurized gas drive beverage to exit through a lumen of the needle, or otherwise allow beverage to flow from the container.

In another aspect of the invention, the needle guide may help shield the needle tip from contact, and/or help shield unwanted spray from the needle opening. For example, the needle may have an opening near the distal end of the needle, and the needle guide may have a through hole arranged to receive the needle and to direct any liquid expelled from the needle opening away from the proximal end of the needle. In one embodiment, the through hole may have a tapered shape so that the through hole is wider at a lower end, i.e., at a location located further from a proximal end of the needle than an upper end of the through hole. The size and shape of the through hole at the upper end may closely approximate the needle shaft so that if any liquid is discharged from the needle opening (e.g., by operating a valve to discharge gas from the needle opening), the liquid may be directed by the through hole in a direction away from the proximal end of the needle. This may direct the liquid to flow away from the user, avoiding contact of the liquid with the user.

In another aspect of the invention, a method for extracting a beverage from a container includes inserting a needle through a closure of a container by moving the needle toward a needle guide. The closure may seal an opening of the container prior to needle insertion such that a beverage in the container is prevented from passing through the opening. For example, the closure may be a cork of a wine bottle that seals the wine bottle opening closed. A surface of a needle base positioned near a proximal end of the needle may be engaged with the needle guide, e.g., as the needle is inserted into the closure, to guide movement of the needle relative to the needle guide. The surface of the needle base in some embodiments may be positioned around a radially outer side of the needle, e.g., may include a conical surface positioned radially around the needle shaft. A beverage may be extracted from the container via the needle while the needle is inserted through the closure, e.g., by introducing gas into the container via the needle and allowing beverage to flow through the needle and outside of the container.

The needle may be arranged to be used with closures that include a material capable of resealing upon withdrawal of the needle from the closure. For example, typical wine bottle corks may allow a needle to be passed through the cork to extract wine from the bottle, and then reseal upon removal of the needle such that gas and/or liquid are prevented from passing through the cork after needle removal.

In one embodiment, the engagement of the needle base and needle guide includes engaging a conically shaped surface of the needle base with a conically shaped surface of the needle guide. For example, the needle base may include a conical member that is received into a conical hole of the needle guide, or vice versa. The needle guide may include a through hole that receives the needle and guides the needle in motion relative to the needle guide, e.g., a part of the through hole may contact the needle shaft as suitable to guide movement of the needle. The needle guide may also be arranged such that upon withdrawal of the needle from the closure and positioning of the needle in a fully withdrawn position, the needle opening at a distal end of the needle may be shielded by the needle guide.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

Figure 1:
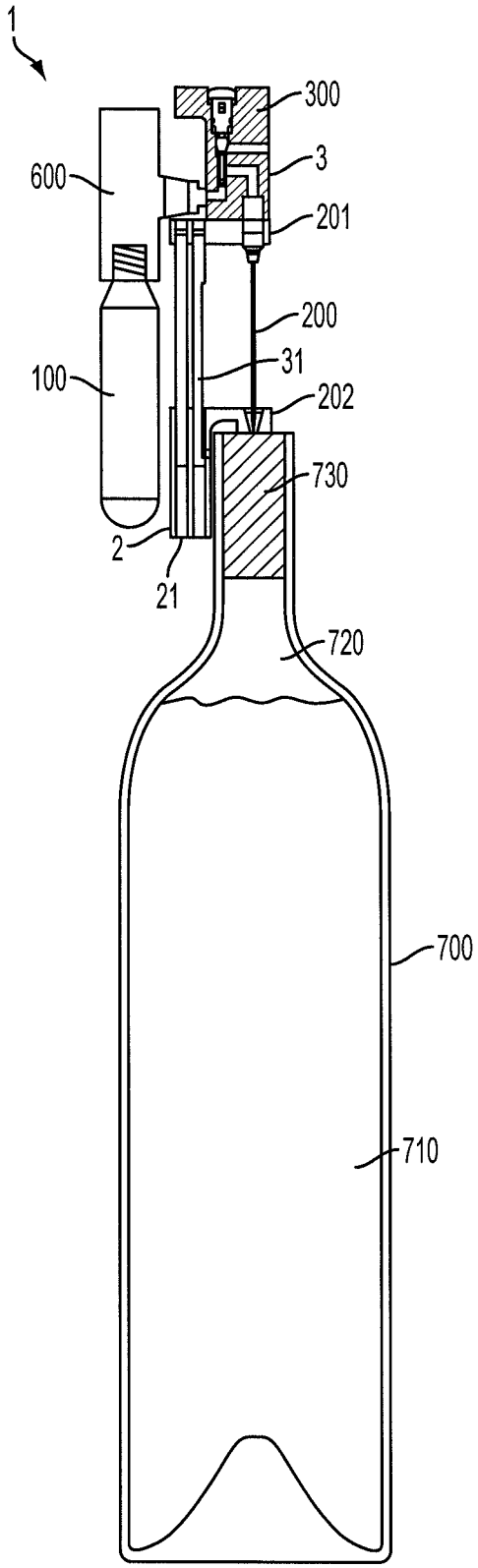
FIG. 1 shows a sectional side view of a beverage extraction device in preparation for introducing a needle through a closure of a beverage container.

FIG. 1 shows one embodiment of a beverage extraction system 1 that incorporates one or more aspects of the invention. This illustrative system 1 includes a body 3 with an attached pressurized source of gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described in U.S. Pat. No. 4,867,209; U.S. Pat. No. 5,020,395; and U.S. Pat. No. 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or two-stage pressure regulators capable of regulating gas pressures to a pre-set or variable outlet pressure. The main function of the regulator 600 is to provide gas at a pressure and flow rate suitable for delivery to the container 700, e.g., so that a pressure established inside the container 700 does not exceed a desired level.

In this embodiment, the body 3 also includes a valve 300 operable to control the flow of gas from the regulator 600. The valve 300 may be a 3-way toggle valve that includes a single operation button and functions to selectively introduce pressurized gas into the container 700 and extract beverage 710 (such as wine) from the container 700 via a needle 200. Details regarding the operation of such a valve 300 are provided in U.S. Pat. No. 8,225,959, which is incorporated by reference in its entirety. Of course, other valve arrangements for controlling pressurized gas and beverage flow are possible. For example, the 3-way valve 300 could be replaced with a pair of on/off valves, one for controlling gas introduction to the container 700, and another for controlling flow of beverage from the container 700. Each valve could have its own actuator, allowing a user to selectively open and close the valves, whether individually or simultaneously. In short, details regarding the operation of the regulator 600 and valve 300 or other mechanisms for introducing gas into a container, and removing beverage from the container 700 are not necessarily limitations on aspects of the invention and may be modified as suitable.

To introduce gas into the container 700 and extract beverage, a needle 200 attached to the body 3 is inserted through a cork or other closure 730 that seals an opening of the container 700. This illustrative system 1 uses a pencil-tip non-coring needle 200 with a needle opening 220 along a sidewall of the needle near the needle tip. While the needle 200 may be inserted into the cork or other closure 730 in different ways, in this embodiment, the system 1 includes a base 2 with a pair of channels 21 that receive and guide movement of respective rails 31 of the body 3. Thus, movement of the body 3 and attached needle 200 relative to the container closure 730 may be guided by the base 2. Other arrangements for guiding movement of the body 3 relative to the base 2 are possible, such as providing one or more rails on the base 2 which engage with the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others.

In some embodiments, the base 2 may be fixed or otherwise held in place relative to the container 700, e.g., by a clamp, sleeve, strap or other device that engages with the container 700. By fixing the base 2 relative to the container 700, such an arrangement may help guide motion of a needle 200 relative to the container 700 when penetrating a closure 730, or when being withdrawn from the closure 730. In another embodiment, the base 2 may include a component that receives a larger part of the container 700, such as a stand that supports a bottom of the container 700 so that the container is effectively held in place relative to the base 2. Alternately, a user may simply hold the base 2 in place relative to the container 700, e.g., by simultaneously gripping a part of the base 2 and a neck of the container 700.

Figure 2:
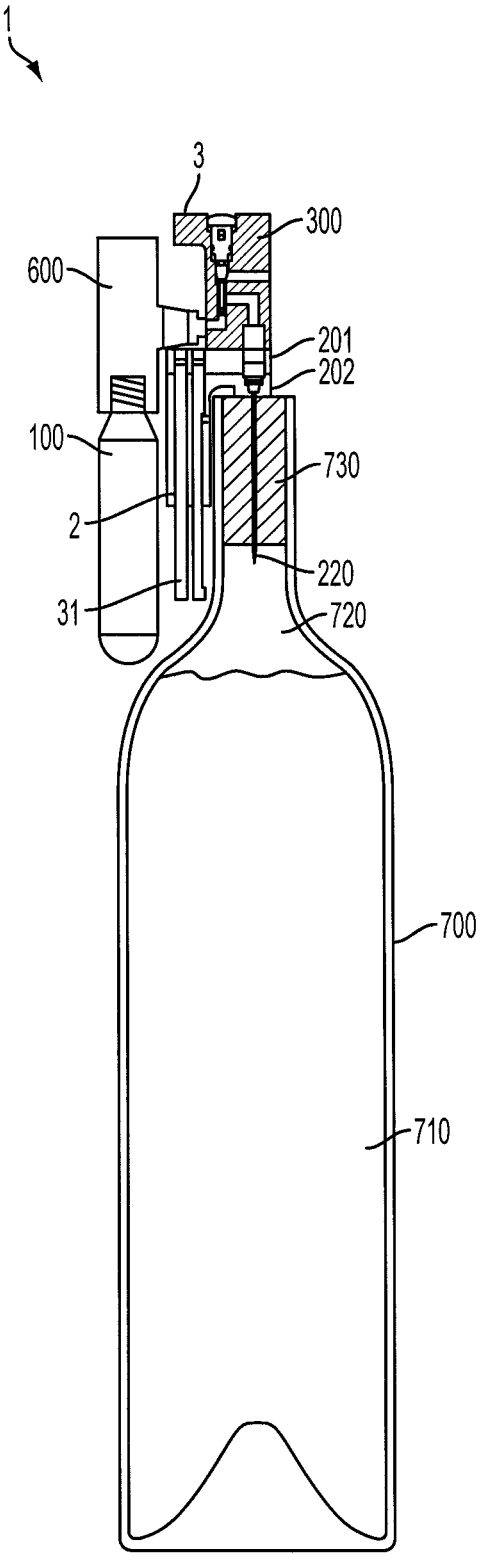
FIG. 2 shows the FIG. 1 embodiment with the needle passed through the closure.
Figure 3:
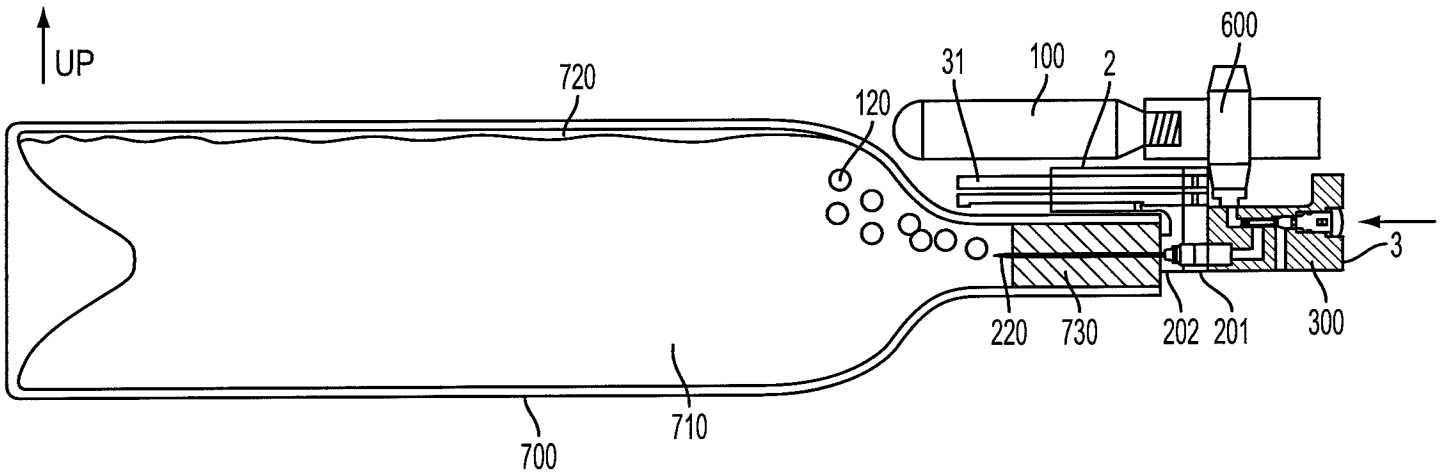
FIG. 3 shows the FIG. 1 embodiment while introducing gas into the container.
Figure 4:
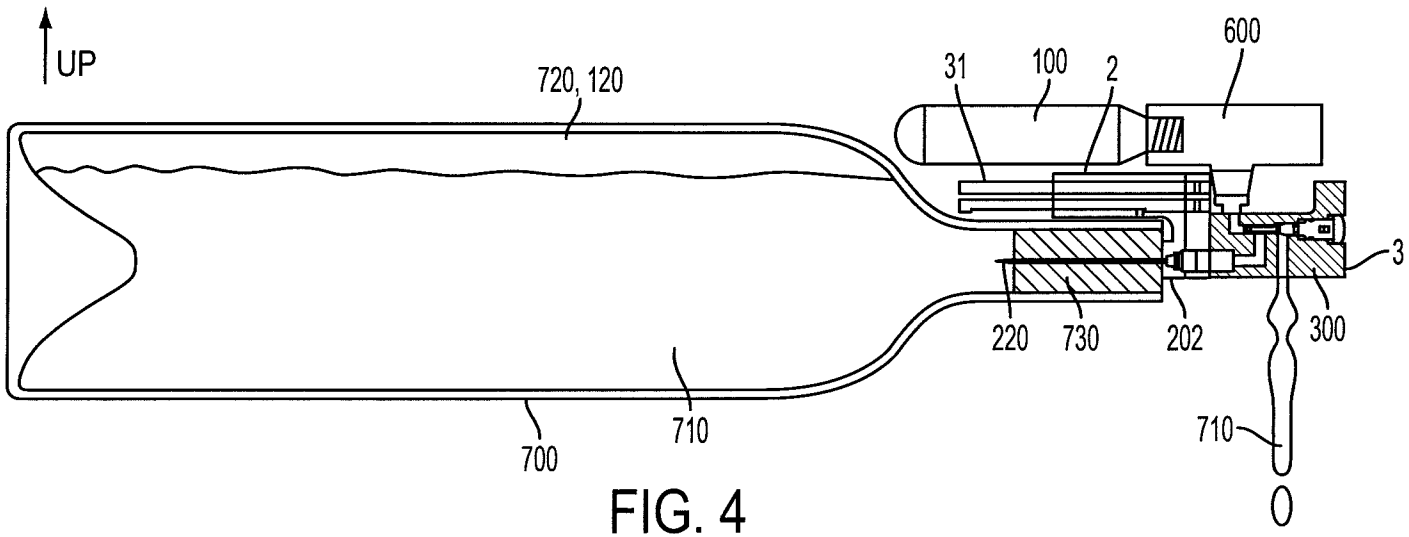
FIG. 4 shows the FIG. 1 embodiment while dispensing beverage from the container.

To insert the needle 200 through the closure 730, a user may push downwardly on the body 3 while maintaining the base 2 and the container 700 stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the container 700. The container 700 may then be tilted, e.g., so that the beverage 710 flows to near the closure 730 and any air or other gas 720 in the container 700 flows away from the closure. Pressurized gas 120 may then be introduced into the container 700 by actuating the valve 300 and causing gas from the cylinder 100 to flow through the valve 300 and needle 200 to exit at the needle opening 220, as shown in FIG. 3. Thereafter, the valve 300 may be operated to stop the flow of pressurized gas and allow beverage 710 to flow into the needle opening 220 and through the needle 200 to be dispensed from the valve 300, as shown in FIG. 4.

In accordance with an aspect of the invention, the beverage extraction system includes a needle base and needle guide that are arranged to engage with each other to guide movement of the needle relative to the needle guide. For example, engagement of the needle base and needle guide may help properly align a portion of the needle with the needle guide, and/or help reduce bending stress on the needle as the needle is inserted into the container closure. Generally, it is desired to have the needle penetrate a closure while following a straight vertical path that is perpendicular to a leading face of the closure. However, in some cases the needle may follow a different path, whether due to a bend in the needle or other conditions, and in such cases, the inventors have found it preferable to have a needle base engage with a needle guide to help guide the needle movement. This helps reduce stresses on the relatively less robust needle, and may help reduce needle wear and reduce a chance of causing needle damage. In some cases, the needle shaft may engage with the needle guide as well as the needle base, e.g., to help reduce bending forces on the needle, although in other embodiments avoiding all contact of the needle with the needle guide may be desired.

In the illustrative embodiment of FIGS. 1-4, a needle base 201 is shown at a proximal end of the needle 200, and serves to removably attach the needle 200 to the body 3. For example, the needle base 201 may engage with the body 3 by way of a threaded connection, a bayonet connection, a clamp, or other arrangement, and thereby attach the needle 200 (which is fixed to the base 201 in this embodiment) to the body 3. In other embodiments, however, the needle 200 may be attached to the body 3 separate from the needle base 201, e.g., the needle 200 may include a thread at its proximal end that engages with a threaded hole of the body 3, and the needle base 201 may be formed as a unitary part with a portion of the body 3. In another embodiment, the needle base 201 may include a compression fitting that engages the needle when the base 201 is engaged with the body 3, e.g., in a way similar to how plumbing-type compression fittings engage a tube. Other arrangements are possible, however.

A needle guide 202 that serves to guide the needle in its movement relative to the base 2 is shown attached to the base 2 and is positionable over the closure 730 of the container 700. In this embodiment, the needle guide 202 includes a conically-shaped hole 203 that receives the needle 200 and is arranged to receive and engage with a portion of the needle base 201, which has a conically shaped engagement surface that is complementary to the conical hole of the needle guide 202. For example, in the position shown in FIG. 2, the needle base 201 may be received at least partially into the needle guide 202 to help support the needle 200 relative to the guide 202. Accordingly, the needle base 201 and needle guide 202 may each include engagement surfaces arranged to contact each other so that the needle 200 and needle base 201 are guided in movement relative to the needle guide 202. By having contact between the needle base 201 and the needle guide 202 help guide movement of the needle 200, damage to the needle 200 may be prevented or otherwise resisted.

Figure 5:
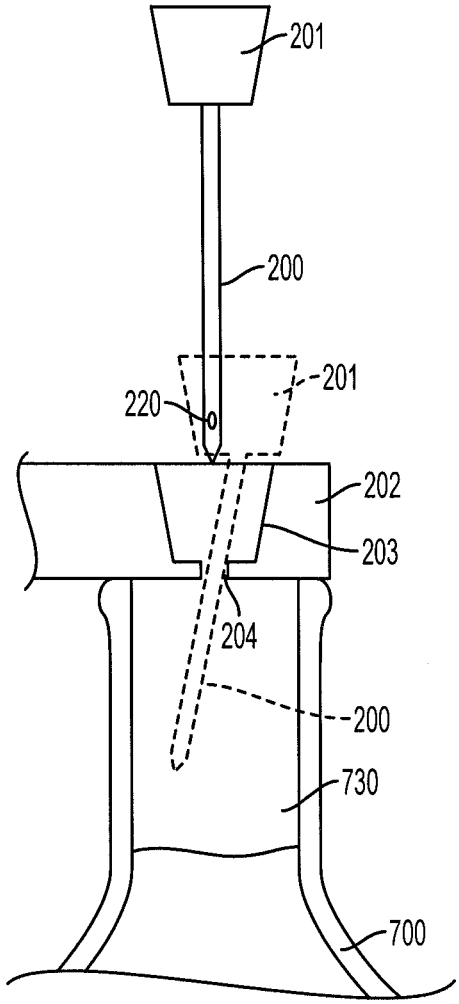
FIG. 5 shows a close up view of a needle guide and needle base arrangement in an illustrative embodiment.

To help illustrate how engagement of the needle base and needle guide may support a needle, FIG. 5 shows an illustrative example of a needle 200, needle base 201 and needle guide 202 in a situation where the needle follows an undesired path through a closure 730. As in the FIGS. 1-4 embodiment, the needle base 201 has a conical portion, and the needle guide 202 includes a conically-shaped hole 203 and a relatively small lower opening or through hole 204. The lower opening or through hole 204 may be close in size to the outer diameter of the needle 200 and help ensure that the distal end of the needle 200 (i.e., near the needle opening 220) is suitably guided toward the closure 730. For example, a needle 200 may be relatively long (e.g., about 3-4 inches long) and being cantilevered from the needle base 201, may tend to be misdirected in movement toward the closure 730, e.g., due to bending of the needle 200 or the needle otherwise moving from a desired target when being introduced into the closure 730. Thus, the lower opening 204 may be sized and shaped to engage with the needle's distal end and guide the distal end suitably toward the closure 730, even where the needle 200 is bent or otherwise would follow an undesired path in the absence of the guide 202.

In some cases, even though the lower opening 204 of the needle guide 202 may accurately guide the needle tip to a desired location of the closure 730, a needle 200 may follow an undesired path through the closure 730. For example, whether due to a bent needle, a closure 730 with anisotropic properties (e.g., a cork which is harder or more resistant to penetration in some areas than others), or other causes, the needle 200 may follow an angled or other undesired path into the closure 730, as shown in dashed line (and highly exaggerated form) in FIG. 5. This type of path may exert bending forces on the needle 200, and may cause the needle 200 to rub against or otherwise contact a part of the lower opening 204 as the needle is moved into or out of the closure 730. This contact may scrape or otherwise tend to remove a friction-reducing coating on the needle 200 (e.g., a PTFE coating), or otherwise subject the needle to unwanted contact with the lower opening 204. In addition, bending forces on the needle 200 near the base 201 may become undesirably high as the proximal end of the needle approaches the lower opening 204, and tend to cause plastic deformation of the needle 200, e.g., at the connection point between the needle and the needle base. To help reduce unwanted contact of the needle 200 with the lower opening 204 and/or reduce bending forces experienced by the needle 200 (e.g., near the needle base 201), the needle base 201 may engage with the needle guide 202 so that the needle 200 is more accurately guided in its movement relative to the lower opening 204 or other portion of the device 1 as well as help reduce bending moments on the needle near the base 201. For example, the conical portion of the base 201 may engage with the conically-shaped hole 203 of the guide 202 so that as the base 201 moves into the hole 203, the base 201 and needle 200 are moved into better alignment with the guide 202. In the example of FIG. 5, further downward movement of the needle 200 from the position shown in dashed line will cause the needle base 201 to engage with the hole 203 of the needle guide 202 even though the needle 200 is not perfectly aligned with the guide 202. As a result, the needle guide 202 will urge the needle base 201 and the needle 200 to the left as seen in FIG. 5, which may tend to straighten the needle's path relative to the lower opening 204 and/or help avoid contact between the needle 200 and the opening 204. Also, this action may reduce bending forces on the needle 200, such as forces that may tend to cause the needle 200 to bend in areas near the needle base 201, because the needle base 201, rather than the needle 200 itself, may bear or counteract some of the bending force on the needle.

Figure 6:
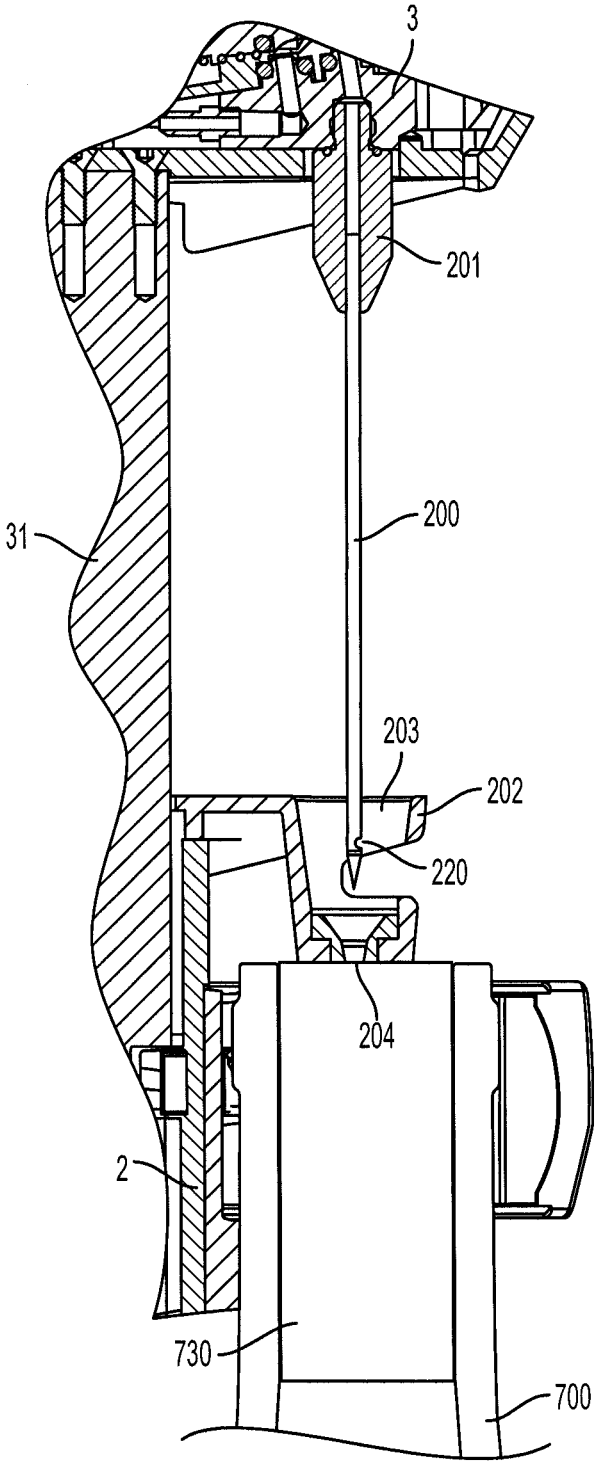
FIG. 6 shows a partial cross sectional view of a needle base, needle guide and needle in a withdrawn position of another illustrative embodiment.

Engagement surfaces of the needle base and needle guide that contact each other to help guide needle movement may be arranged in different ways than that shown, yet still provide support for the needle movement. In addition, the needle guide may be arranged to shield the needle tip and/or opening. For example, FIG. 6 shows a partial view of a beverage extraction system 1 that includes a needle base 201 having a conical outer surface and a needle guide 202 having a conically-shaped hole 203 arranged to receive the needle base 201. In accordance with an aspect of the invention, with the needle 200 positioned in a fully upward or retracted position relative to the needle guide 202, a distal end of the needle 200 and the needle opening 220 are located in the hole 203 of the needle guide 202. This arrangement may help shield the needle tip (which may be a pointed element) from contact with a user or other objects, e.g., to help prevent damage to the needle. Also, positioning of the opening 220 in the needle guide 202 may help contain any liquid or other material that may be ejected from the opening 220 if pressurized gas is delivered to the opening 220. For example, in some cases, a small amount of wine or other beverage may be retained in the needle 200 after dispensing a beverage. Thus, if the valve 300 is operated to deliver gas to the needle 200 in the position shown in FIG. 6, the gas may drive the wine or other liquid from the opening 220. However, since the opening 220 is positioned in or otherwise shielded by the guide 202, the liquid spray may be prevented from contacting a user or other object outside of the guide 202. Note also that in this illustrative embodiment, the lower opening 204 includes a conically-shaped or tapered hole. This may help guide the needle tip to a desired location when the needle is moved downwardly toward the needle guide 202.

Figure 7:
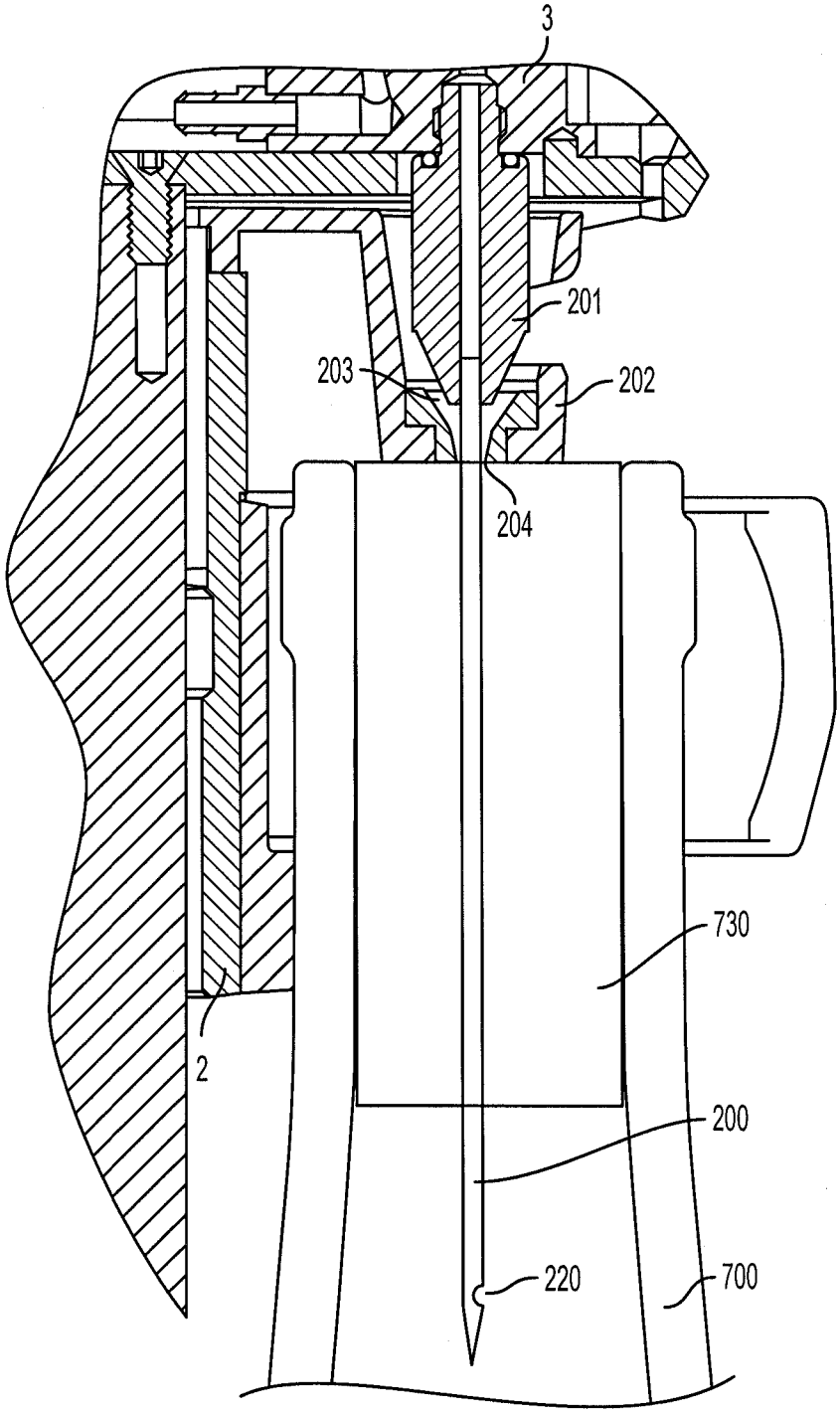
FIG. 7 shows the FIG. 6 embodiment with the needle in an inserted position.

FIG. 7 shows the needle 200 in a nearly fully extended position with the needle 200 extending through the closure 730 and the needle base 201 received into the needle guide 202. In this embodiment, the hole 203 includes two tapered sections, an upper section with a relatively more gradual (or more vertical) taper, and a lower section with a more sharp (or less vertical) taper that is similar in taper angle to a leading conical face of the needle base 201. Thus, an upper section of the hole 203 may accommodate larger displacements of the needle base 201 relative to the needle guide 202 and guide the base 201 into a more accurately aligned position as guided by the lower section of the hole 203. Of course, the hole 203 could be arranged in other suitable ways, such as having an upper cylindrical portion and a lower tapered portion, three or more distinct portions having different taper angles, a single tapered section, other curved or suitable shapes, etc.

Figure 8:
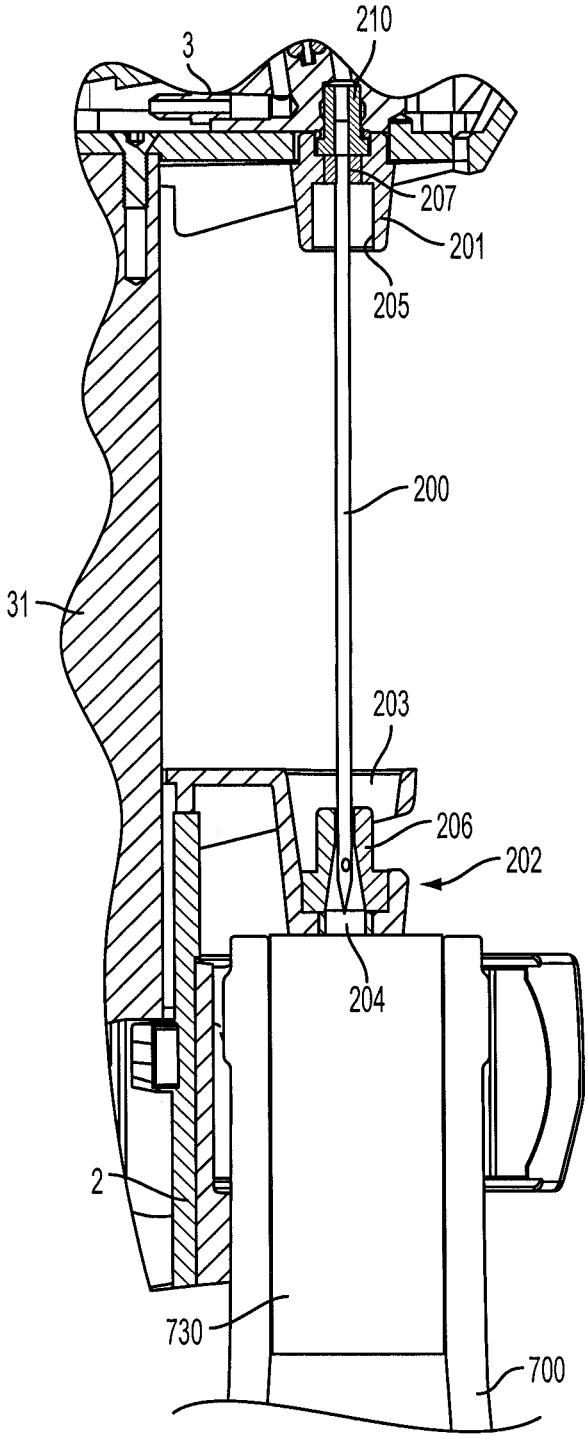
FIG. 8 shows a partial cross sectional view of a needle base, needle guide and needle in a withdrawn position of yet another illustrative embodiment.
Figure 9:
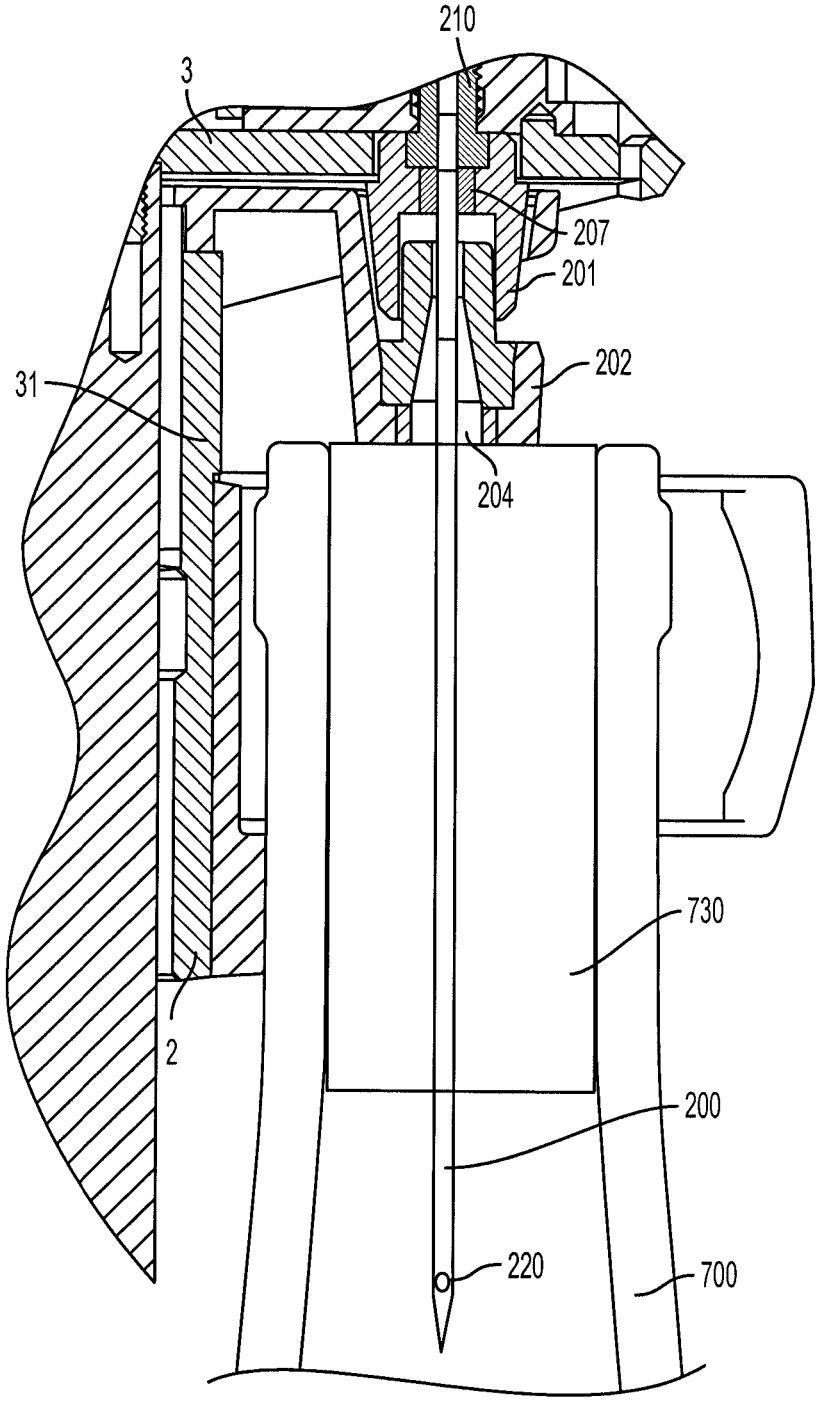
FIG. 9 shows the FIG. 8 embodiment with the needle in an inserted position.

FIGS. 8 and 9 show another illustrative embodiment of a needle base and needle guide, e.g., in which the needle base and needle guide include concentric engagement surfaces. In this embodiment, the needle guide 202 includes a hole 203 to receive a portion of the needle base 201 as in the FIGS. 6 and 7 embodiment. In addition, the needle base 201 in this embodiment includes a guide hole 205 that receives a protrusion 206 of the needle guide 202. The hole 205 in the base 201 may be tapered, e.g., have a conical shape that flares downwardly or toward the distal end of the needle, and may be complementary to the shape of the protrusion 206 (which may have a conically-shaped portion). Of course, other arrangements are possible, such as a cylindrical shape for the protrusion 206 and/or the hole 205, etc. Moreover, the needle guide 202 need not necessarily include the hole 203, and instead guiding of the needle 200 relative to the base 2 may be performed by engagement of the guide hole 205 and the protrusion 206. While in this embodiment the guide hole 205 and protrusion 206 are formed by solid elements having a continuous surface that surrounds the needle 200, other arrangements are possible such as where the guide hole 205 includes multiple holes that each receive a corresponding pin of the protrusion 206. Alternately, the protrusion may include multiple pins, ribs or other elements that together form an engagement surface that engages with the hole 205. Other arrangements are possible.

Note also that the lower opening 204 in this embodiment flares outwardly toward the bottom of the opening 204 so that the opening 204 is closer in size to the needle outer surface in an upper region than at a lower region of the opening 204. This may increase a surface area between the opening 204 and the needle 200, e.g., if the needle 200 enters the closure 730 at an angle. An increased contact area between the lower opening 204 and the needle 200 may help reduce local frictional forces on the needle and/or help prevent bending of the needle 200. Also, positioning the needle opening 220 in the lower opening 204 of this shape may help direct any liquid that is expelled from the opening 220 in a downward direction, away from the proximal end of the needle.

Another aspect of the invention illustrated in FIGS. 8 and 9 is that the connection of the needle 200 to the needle base 201 and/or engagement of the needle base and needle guide are arranged to help reduce stresses on the needle at the connection point between the needle and the needle base. For example, in the FIGS. 8 and 9 embodiment, the needle 200 is attached to a hub 210 which engages the needle base 201. The needle 200 and hub 210 may be made of a metal material, and connected together by brazing, welding, a threaded connection, etc. Since the hub 210 engages with the needle base 201 at a proximal or upper end of the base 201, the needle 200 is connected to the needle base 201 at a point that is above or otherwise positioned away from an uppermost location where the needle guide protrusion 206 can be received into the hole 205. By increasing a shortest possible distance between the needle guide 202 and the connection point between the needle 200 and the needle base 201, stresses may be reduced on the needle 200 at the connection point. For example, if the protrusion 206 and the hole 205 are somewhat misaligned, the needle guide 202 may tend to urge the needle 200 to move in a direction opposite of that urged by the needle base 201 on the needle 200. Of course, engagement of the protrusion 206 with the hole 205 (or other guide/base engagement) may help alleviate that stress on the needle, but nonetheless, the needle 200 may bear stress as a result, and such stress may be focused at the connection point of the needle 200 to the hub 210, e.g., because the needle 200 is not free to slide or otherwise move relative to the hub 210. By effectively separating or distancing the point at which the needle guide 202 contacts the needle 200 from the connection point of the needle to the hub 210/base 201, stress on the needle at the connection point may be reduced, e.g., because the needle may bend elastically between the connection point and the contact point of the needle guide 202 with the needle. In the FIGS. 8 and 9 embodiment, this separation is achieved, at least in part, by recessing the connection point of the needle 200 to the base 201 relative to the hole 205.

In addition, a needle bore 207 formed in the needle base 201 that receives the needle 200 and hub 210 may be sized, shaped or otherwise arranged to help support the needle 200 between the connection point and the hole 205. For example, while in this embodiment the needle bore 207 is made relatively large so as to avoid contact with the needle 200, the needle 200 may closely fit the bore 207 so the portion of the needle base 201 around the bore 207 supports the needle 200. However, since the needle 200 need not be directly connected to the bore 207, the needle 200 may still be able to slide relative to the bore 207 (e.g., due to bending of the needle 200) so that stress or strain concentrations can be eliminated. Also, the portion of the base 201 around the bore 207 may be made somewhat resilient so that the needle base 201 supports the needle 200, but will give with excessive needle deflection. For example, in the FIGS. 8 and 9 embodiment, the gap between the needle 200 and the needle bore 207 below the hub 210 may be filled with a rubber or other resilient material. In another embodiment, the needle bore 207 may be made to closely fit the needle 200 in the area below the hub 210, and the needle base 201 may be made of a plastic material that provides suitable support without excessively restraining the needle 200. In addition, a distal portion of the bore 207 near the hole 205 may flare outwardly and downwardly so that the base 201 does not contact the needle 200 in an area immediately above the hole 205 (or only contacts the needle 200 with relatively large bending of the needle). This may allow the needle 200 to bend or otherwise deflect in areas near the hole 205, while being supported by the base 201 when the needle 200 deflects to relatively greater extents.

Alternately or in addition, other arrangements are possible to aid in reducing stress on the needle 200, such as arranging the through hole 204 so that the through hole 204 makes contact with the needle 200 at a lower point relative to the connection point, or attaching the needle 200 to the needle base 201 at the connection point so as to allow for pivoting and/or lateral movement of the needle 200 relative to the base 201. This pivoting or lateral movement may be accommodated by a spherical joint (e.g., a ball-shaped element on the needle 200 may engage with the needle bore 207 in the base 201 to allow for pivoting movement of the needle 200 relative to the base 201), by providing a resilient material at the connection point (such as a resilient gasket that allows for needle movement), by providing a sliding joint (e.g., a washer-shaped element on the needle 200 may be captured in a relatively larger space in the base 201 that allows for lateral movement—movement perpendicular to the needle's length—relative to the base 201), and others.

Figure 10:
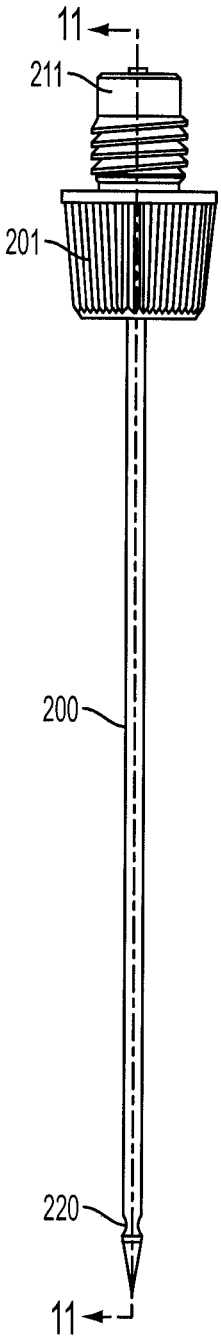
FIG. 10 shows a side view of a needle assembly in an illustrative embodiment.
Figure 11:
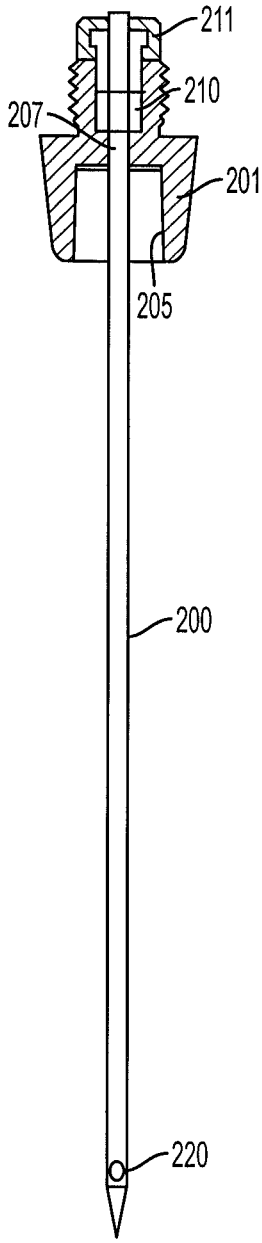
FIG. 11 shows a cross sectional view along the line 11-11 in FIG. 10.

FIGS. 10 and 11 show side and cross sectional views of a needle assembly in an illustrative embodiment. In this example, the needle 200 and needle base 201 are arranged similarly to that shown in FIGS. 8 and 9. However, in this embodiment, the needle base 201 includes a threaded portion that engages with the body 3 of the extraction device 1 rather than having the hub 201 threadedly engage with the body 3. This arrangement may further help to reduce stress because any force exerted on the needle base 201 by the needle guide 202 will be transferred directly from the needle base 201 to the body 3 rather than being transferred through the hub 201 and/or needle 200 to the body 3. Other connection arrangements for the needle base 201 to the body 3 are possible instead of a threaded connection, including the use of a clamp (such as collet-type clamp on the body 3 that engages the needle base 201), a bayonet connection, a quick connect arrangement (similar to that found in air hose connectors), etc. Also, while in this embodiment the hub 210 includes two parts, e.g., a lower part which is brazed, welded, etc. to the needle 201 and an upper part that slides over the proximal end of the needle 200 as a sleeve and helps anchor a gasket 211 to the assembly, the hub 210 could include a single part (or more than two parts). For example, the hub 210 could include only the upper part shown in FIG. 11. Such an arrangement would further distance the needle/hub connection point from the hole 205, helping to reduce stress/strain on the needle. The needle bore 207 may be sized and shaped to fit closely to the needle 200 to help support the needle 200. As discussed above, the needle 200 need not be fixed in the bore 207 but rather be permitted to slide relative to the bore 207, and the bore 207 may be flared outwardly in a distal portion near the hole 205. Last, in this embodiment, a seal between the needle 200 and the body 3 is provided by a gasket 211 (e.g., a cup-shaped element made of a rubber or other resilient material) that engages with the needle 200 and the body 3 when the needle base 201 is threaded onto the body 3. An outer surface of the needle base 201 may be knurled or ribbed to help a user grip the base 201 when threading the assembly to the body 3 and may function as an engagement surface, e.g., to engage with a hole 203 of a needle guide 202.

Figure 12:
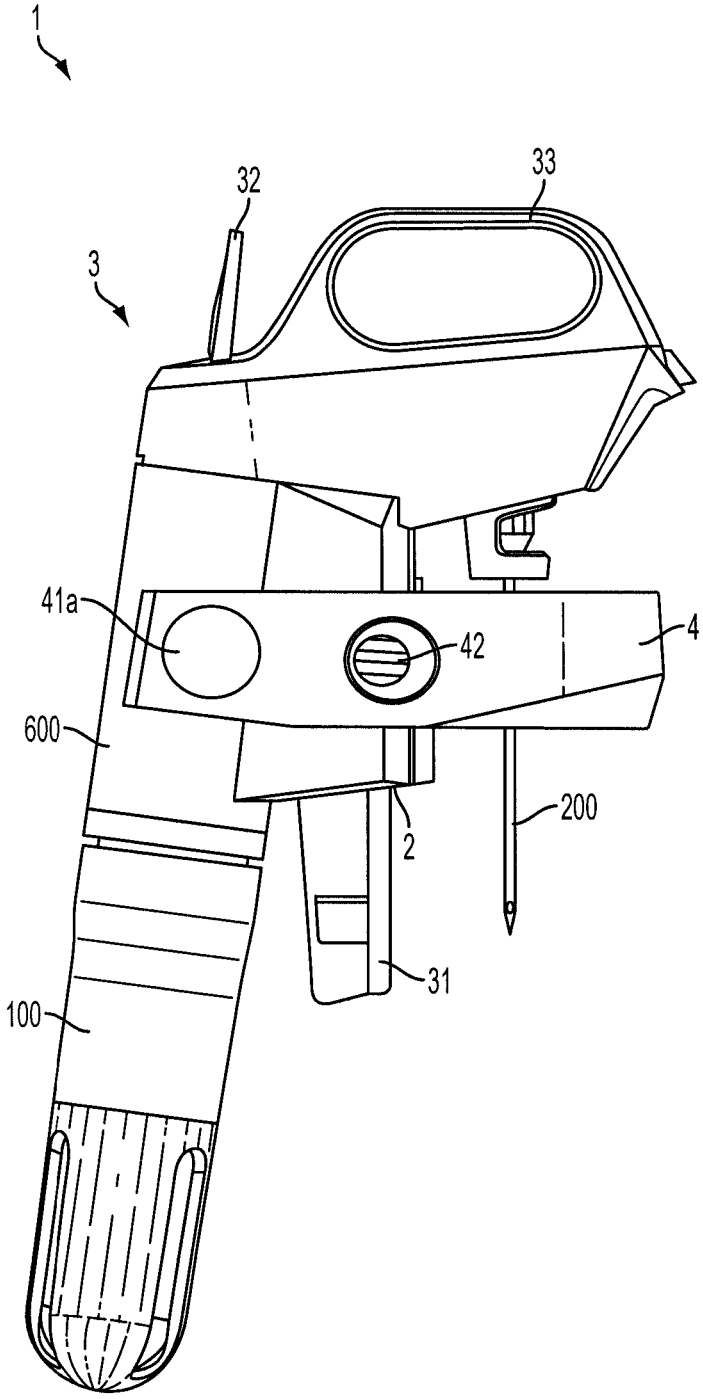
FIG. 12 shows a side view of an illustrative embodiment of a beverage extraction system including a container clamp.
Figure 13:
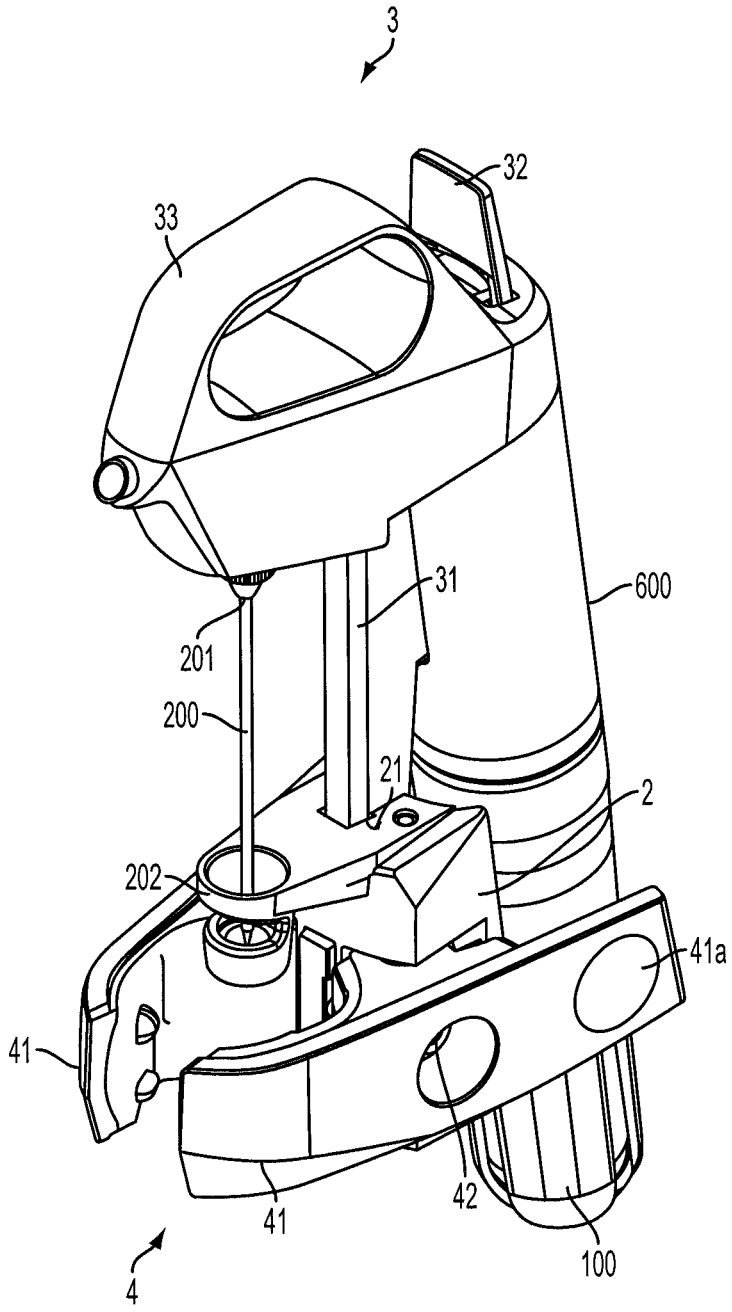
FIG. 13 shows a perspective view of the FIG. 12 embodiment.

FIGS. 12 and 13 show another illustrative embodiment of a beverage extraction system 1 that incorporates aspects of the invention. In this embodiment, the body 3 includes a handle 33, that may be gripped by a user for moving the body 3 relative to the base 2 in upward and downward motions to insert a needle 200 through a cork or other closure of a container 700. The body 3 includes a rail 31 that has T-shaped cross section, and is arranged to move within a T-shaped receiving slot 21 of the base 2. As discussed above, other arrangements are possible for engaging the body 3 and base 2 while allowing for movement of the needle 200. The cylinder 100 includes a vented cup that threadedly engages with the body 3 at the regulator 600 to engage and hold the cylinder 100 in place relative to the body 3.

This embodiment also includes a clamp 4 to engage the base 2 with a container 700, e.g., by clamping to the neck of a bottle. The clamp 4 includes two arms 41 and a locking mechanism that includes a pair of torsion springs 42 to secure the arms 41 to a container. That is, each arm 41 is pivotally mounted to the base 2 at respective a pivot axis so that distal ends of the arms 41 (i.e., portions near the needle guide 202) may be moved toward and away from each other by moving finger pad portions 41*a* of the arms 41 toward and away from each other. With the needle guide 202 positioned over the closure 730, the arms 41 may be moved to position the neck of a container between the distal ends of the arms. The arms 41 may then be moved to clamp the neck, e.g., by releasing the finger pad portions 41*a* and allowing the torsion springs 42 to urge the distal ends of the arms together around the neck. Alternately, the arms 41 may be secured together in other ways, such as by a ratchet and pawl mechanism, a detent, a buckle and strap, a screw and nut (in which the screw engages one arm 41, the nut engages the other arm 41, and the screw and nut threadedly engage each other to secure the arms 41 together) or other arrangement suited to engage the arms 41 with the container 700.

The clamp 4 may also operate to ensure that the cork is centered beneath the needle 200 and that the needle guide 202 rests atop the cork or other closure. Of course, the clamp 4 could be arranged in other ways, e.g., replaced by a cylinder that fits over a bottle neck and has a split wall with a conically tapered outer surface. An outer ring could be slid along the conical surface of the cylinder to cause the inner diameter of the cylinder to decrease, clamping the cylinder about the bottle neck. Other arrangements are possible. Also, the needle guide 202 may function to help retain a closure 730 in the container opening by maintaining the closure in position relative to the container 700, whether during use of the system 1 (e.g., introduction of pressurized gas into the container 700) or during withdrawal of the needle 200 from the closure. That is, the needle guide 202 may contact the top of the closure 730 and resist upward movement of the closure 730 relative to the container opening.

It has been found that needles having a smooth walled exterior, pencil point or Huber point needle of 16 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the container and any remaining beverage to be stored for months or years without abnormal alteration of the beverage flavor. Further, such needles may be used to penetrate a foil cover or other wrapping commonly found on wine bottles and other containers. Thus, the needle may penetrate the foil cover or other element as well as the closure, eliminating any need to remove the foil or other wrapping prior to beverage extraction. Other needle profiles and gauges are also usable with the system.

While in the above embodiments the needle guide 202 and needle are positioned to have the needle penetrate the center of the closure 730, the lower opening 204 or through hole of the guide 202 could be arranged to introduce the needle at a location offset from the center of cork 730. This may decrease the chances that a needle penetrates the closure 730 in a same location if the system 1 is used to dispense beverage from the container several times and may allow the closure 730 to better reseal upon needle withdrawal.

While in the above embodiments, a user moves the body 3 in a linear fashion relative to the base 2 to insert/remove a needle with respect to a container closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source.

A needle used in a beverage extraction system may be a smooth exterior walled, cylindrical needle with a non-coring tip that can be passed through a cork without removing material from the cork. One non-coring tip is a pencil-tip that dilates a passageway through the cork, although deflected-tip and stylet needles have also been found to work properly and could be used in alternative embodiments. The pencil-tip needle preferably has at least one lumen extending along its length from at least one inlet on the end opposite the pencil-tip and at least one outlet proximal to the pencil-tip. As shown above, a needle outlet may be positioned in the side-wall of the needle at the distal end of the needle, although proximal of the extreme needle tip.

With the correct needle gauge, it has been found that a passageway (if any) that remains following removal of the needle from a cork self-seals against egress or ingress of fluids and/or gasses under normal storage conditions. Thus, a needle may be inserted through a closure to extract beverage, and then be removed, allowing the closure to reseal such that beverage and gas passage through the closure is prevented. While multiple needle gauges can work, preferred needle gauges range from 16 to 22 gauge, with an optimal needle gauge in some embodiments being between 17 and 20 gauge. These needles gauges may offer optimal fluid flow with minimal pressures inside the container while doing an acceptably low level of damage to the cork even after repeated insertions and extractions.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches. Creating distance between the inlet/outlets of the needles can prevent the formation of bubbles.

In some embodiments, a suitable gas pressure is introduced into a container to extract beverage from the container. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the container during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas containers filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the container, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiment above, a single needle with a single lumen is used to introduce gas into the container and extract beverage from the container. However, in other embodiments two or more needles may be used, e.g., one needle for gas delivery and one needle for beverage extraction. In such an embodiment, the valve 300 may operate to simultaneously open a flow of gas to the container and open a flow of beverage from the container. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

Multiples of these components could be combined into single parts or components serving multiple functions. For example, the needle guide may be made part of a container clamp.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A beverage extraction device, comprising:

a base for supporting components of the beverage extraction device;

a needle having at least one lumen extending from a proximal end to a distal end, the needle being movably mounted to the base and arranged to be inserted through a closure at an opening of a beverage container;

a needle base at the proximal end of the needle and having an engagement surface; and a needle guide attached to the base and having an opening to guide the needle in movement relative to the base, the needle guide including an engagement surface arranged to contact the engagement surface of the needle base and guide movement of the needle base and needle relative to the needle guide, wherein the needle guide includes a protrusion that includes the engagement surface of the needle guide, and the needle base includes a hole that includes the engagement surface of the needle base and is arranged to engage with the protrusion.

2. The device of claim 1, wherein the engagement surface of the needle guide includes a conically shaped hole, and the engagement surface of the needle base includes a conically shaped member arranged to fit into the conically shaped hole.

3. The device of claim 1, wherein the needle guide includes a through hole arranged to receive the needle.

4. The device of claim 1, wherein the protrusion includes a conically shaped member with a size and shape that is complementary to the hole of the needle base.

5. The device of claim 1, wherein the needle guide is fixed relative to the base.

6. The device of claim 1, further comprising a gas source fluidly coupled to the needle and arranged to deliver pressurized gas to the at least one lumen at the proximal end of the needle.

7. The device of claim 6, wherein the gas source includes a compressed gas cylinder.

8. The device of claim 1, wherein the needle and needle base are attached to a rail, and the base includes a channel arranged to receive and guide movement of the rail relative to the base.

9. The device of claim 8, comprising a body that includes the rail, and the needle base and needle are attached to the body.

10. The device of claim 1, comprising a body that is movable relative to the base, and wherein the needle base is threadedly engaged with the body such that the needle base and needle are removable from the body.

11. The device of claim 1, wherein the needle is arranged for insertion through a cork of a wine bottle and for delivery of a gas into the wine bottle.

12. The device of claim 1, wherein the needle is arranged for insertion through a cork of a wine bottle and for delivery of wine from the bottle.

13. The device of claim 1, wherein the needle has an opening near the distal end of the needle, the needle guide includes a through hole arranged to receive and guide the needle, and the through hole is shaped to direct any liquid expelled from the needle opening away from the proximal end of the needle.

14. A method for extracting a beverage from a container, comprising:

inserting a needle through a closure of a container by moving the needle toward a needle guide, the closure sealing an opening of the container closed prior to needle insertion such that a beverage in the container is prevented from passing through the opening;

engaging a surface of a hole in a needle base positioned near a proximal end of the needle with a surface of a protrusion of the needle guide received into the hole to guide movement of the needle relative to the needle guide, the surface of the hole in the needle base being positioned around a radially outer side of the needle; and extracting a beverage from the container via the needle while the needle is inserted through the closure.

15. The method of claim 14, wherein the closure includes a material capable of resealing upon withdrawal of the needle from the closure.

16. The method of claim 14, wherein the step of engaging a surface includes engaging a conically shaped outer surface of the needle base with a conically shaped surface of the needle guide.

17. The method of claim 14, wherein the needle guide includes a through hole that receives the needle and guides the needle in motion relative to the needle guide.

18. The method of claim 14, wherein the step of extracting includes introducing gas into the container through the closure via the needle.

19. The method of claim 14, wherein the step of extracting includes flowing beverage from the container and through the closure via the needle.

20. The method of claim 14, comprising:

withdrawing the needle from the closure and positioning the needle in a fully withdrawn position such that a needle opening at a distal end of the needle is shielded by the needle guide.

21. A needle assembly for use with a beverage extraction device, comprising:

a needle having at least one lumen extending from a proximal end to a distal end, the needle being arranged to be inserted through a closure at an opening of a beverage container; and a needle base at the proximal end of the needle and having a needle bore in which the proximal end of the needle is positioned, the needle base having a guide hole in communication with the needle bore and including an engagement surface arranged to receive and engage with a complimentary engagement surface of a protrusion on a needle guide of a beverage extraction device and guide movement of the needle base and needle relative to the needle guide, wherein the needle extends through and from the guide hole of the needle base such that the distal end of the needle is positioned outside of the guide hole.

22. The needle assembly of claim 21, wherein the guide hole is located at a distal end of the needle base and has a conical shape with a wider portion of the conical guide hole positioned distally of a narrower portion of the conical guide hole.

23. The needle assembly of claim 21, further comprising a needle hub attached at a proximal end of the needle and received in the needle bore.

24. The needle assembly of claim 21, wherein the needle base includes a thread arranged to engage with a beverage extraction device to secure the needle assembly to the beverage extraction device.

25. The needle assembly of claim 21, wherein a distal portion of the needle bore is arranged to closely fit around the needle and support the needle.

26. The needle assembly of claim 25, wherein a distal end of the needle bore includes a flared portion arranged so the needle bore is wider at the distal end than at more proximal portions of the needle bore.

27. The needle assembly of claim 21, wherein the needle base is formed of a plastic material.

* * * * *